US008165492B2

(12) United States Patent
Sakuma

(10) Patent No.: US 8,165,492 B2
(45) Date of Patent: Apr. 24, 2012

(54) DEVELOPER CARTRIDGE, DEVELOPING UNIT AND IMAGE FORMING APPARATUS

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 347 days.

(21) Appl. No.: 12/406,333

(22) Filed: Mar. 18, 2009

(65) Prior Publication Data

US 2009/0245855 A1 Oct. 1, 2009

(30) Foreign Application Priority Data

Mar. 27, 2008 (JP) ..... 2008-082965

(51) Int. Cl.
*G03G 15/08* (2006.01)

(52) U.S. Cl. ..... 399/106; 399/262

(58) Field of Classification Search ..... 399/91, 399/102–106, 110, 111, 119, 120, 252, 258, 399/262; 222/DIG. 1
See application file for complete search history.

(56) References Cited

U.S. PATENT DOCUMENTS

| | | | | |
|---|---|---|---|---|
| 5,548,384 | A * | 8/1996 | Weed | 399/120 |
| 5,729,797 | A * | 3/1998 | Okada et al. | 399/120 |
| 6,151,472 | A * | 11/2000 | Nakajima | 399/262 |
| 2007/0223963 | A1 | 9/2007 | Suzuki et al. | |
| 2007/0223964 | A1 | 9/2007 | Takagi | |
| 2007/0223965 | A1 | 9/2007 | Takagi | |
| 2007/0223971 | A1 | 9/2007 | Takagi | |

FOREIGN PATENT DOCUMENTS

| | | |
|---|---|---|
| JP | 2007-293268 | 11/2007 |

* cited by examiner

*Primary Examiner* — Hoan Tran
(74) *Attorney, Agent, or Firm* — Banner & Witcoff, Ltd

(57) ABSTRACT

A developer cartridge includes a first frame and a second frame, which confronts the first frame. The second frame includes an opening, through which developer is passed, and which is openable and closable by the first frame in accordance with a relative movement between the second frame and the first frame, and a seal member, which is provided around the opening, and which does not overlap the first frame as viewed from a direction in which the developer passes the opening when the opening is opened.

11 Claims, 11 Drawing Sheets

17

UP
RI
FR
LO
RE
LE
31
82
94 (93)
102 (47)
110 (110B)
110 (110A)
110C
96
89 (47)
118A
111A
82A
122
87
97
98
97A
92
111
116
83A
117
123
118
109
103
104
105
107
106
83
81
84
100
86
101
47
X

DEVELOPER CARTRIDGE, DEVELOPING UNIT AND IMAGE FORMING APPARATUS

CROSS-REFERENCE TO RELATED APPLICATIONS

This application claims priority from Japanese Patent Application No. 2008-082965 filed on Mar. 27, 2008, the entire subject matter of which is incorporated herein by reference.

TECHNICAL FIELD

Aspects of the invention relate to a developer cartridge for accommodating developer, a developing unit and an image forming apparatus.

BACKGROUND

There has been proposed a developer cartridge, which accommodates developer, and which is mounted to an image forming apparatus such as a laser printer and to a developing unit of the image forming apparatus.

As an example of a related art developer cartridge, JP-A-2007-293268 discloses a toner box having a double structure including an inside housing for accommodating toner and an outside housing for accommodating the inside housing in such a manner as to rotate freely therein. The toner box is installed in a process unit of a laser printer.

In the toner box, the outside housing includes a first toner discharge opening, and the inside housing includes a second toner discharge opening. In the toner box, the inside housing is rotated relative to the outside housing (i.e., relative movement) so that the first toner discharge opening and the second toner discharge opening are made to confront each other for enabling communication between the first toner discharge opening and the second toner discharge opening in order to supply toner from the inside housing to the process unit.

In the toner box, first radial projections formed of an elastic material are provided around the second toner discharge opening on an external surface of the inside housing. When the second toner discharge opening is opened, the first radial projections are exposed partially from the first toner discharge opening to be brought into contact with the process unit. According thereto, the first radial projections can hold a space between the process unit and the inside housing airtight and fluid-tight. Therefore, a toner leakage from the second toner discharge opening may be prevented. That is, in the toner box, the first radial projections function as a seal member.

SUMMARY

The related art developer cartridge described above has some disadvantages. For example, in the toner box of JP-A-2007-293268, since the first radial projection is partially exposed from the first toner discharge opening when the second toner discharge opening is opened, a part of the first radial projection is compressed by both the inside housing and the outside housing. Thus, the first radial projection may be unnecessarily deformed, and the toner may be leaked at a position where the first radial projection is deformed.

Therefore, illustrative aspects of the invention provide a developer cartridge including a first frame and a second frame, in which, when an opening of the second frame is opened and closed by relative movement between the first frame and the second frame, a seal member provided on the second frame for preventing leakage of developer from the opening can be prevented from unnecessary deformation, as well as a developing unit and an image forming apparatus to which the developer cartridge are mounted.

According to one aspect of the invention, there is provided a developer cartridge comprising: a first frame; and a second frame, which confronts the first frame, and which comprises: an opening, through which developer is passed, and which is openable and closable by the first frame in accordance with a relative movement between the second frame and the first frame; and a seal member, which is provided around the opening, and which does not overlap the first frame as viewed from a direction in which the developer passes the opening when the opening is opened.

According to another aspect of the invention, there is provided a developing unit comprising: a developer cartridge comprising: a first frame; and a second frame, which confronts the first frame, and which comprises: an opening, through which developer is passed, and which is openable and closable by the first frame in accordance with a relative movement between the second frame and the first frame; and a seal member, which is provided around the opening, and which does not overlap the first frame as viewed from a direction in which the developer passes the opening when the opening is opened, wherein the developing unit visualizes an electrostatic latent image with the developer in the developer cartridge.

According to still another aspect of the invention, there is provided an image forming apparatus comprising: a developer cartridge comprising: a first frame; and a second frame, which confronts the first frame, and which comprises: an opening, through which developer is passed, and which is openable and closable by the first frame in accordance with a relative movement between the second frame and the first frame; and a seal member, which is provided around the opening, and which does not overlap the first frame as viewed from a direction in which the developer passes the opening when the opening is opened; and an image forming apparatus main body to which the developer cartridge is mounted.

According to the aspects of the invention, in the developer cartridge, the opening, which is formed in the second frame and which confronts the first frame, is closed by the first frame through the relative movement of the first frame and the second frame. When the opening is opened, the passage of developer through the opening is permitted. When the opening is closed, the passage of developer through the opening is restricted. By virtue of the seal member provided on the periphery of the opening on the second frame, leakage of the developer from the opening can be prevented.

The seal member is made not to overlap the first frame when projected from a passage direction of developer at the opening in a state where the opening is opened. That is, the seal member does not contact the first frame when the opening is in the opened state. Therefore, the seal member can be prevented from being deformed by the first frame.

DETAILED DESCRIPTION

Exemplary embodiments of the invention will now be described with reference to the drawings.

(Image Forming Apparatus)

Figure 1:
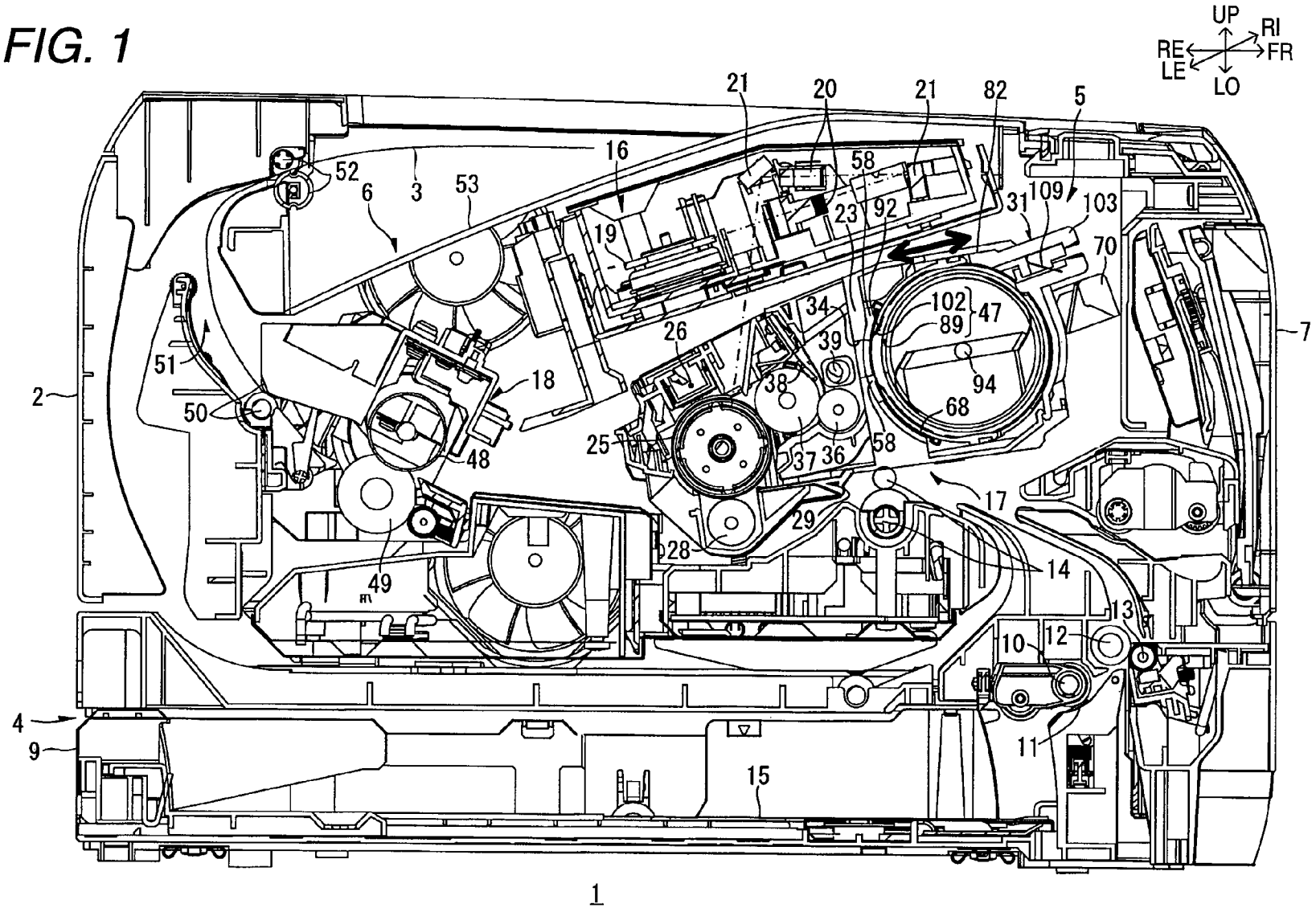
FIG. 1 is a left side sectional view of an image forming apparatus according to an exemplary embodiment of the invention.
Figure 2:
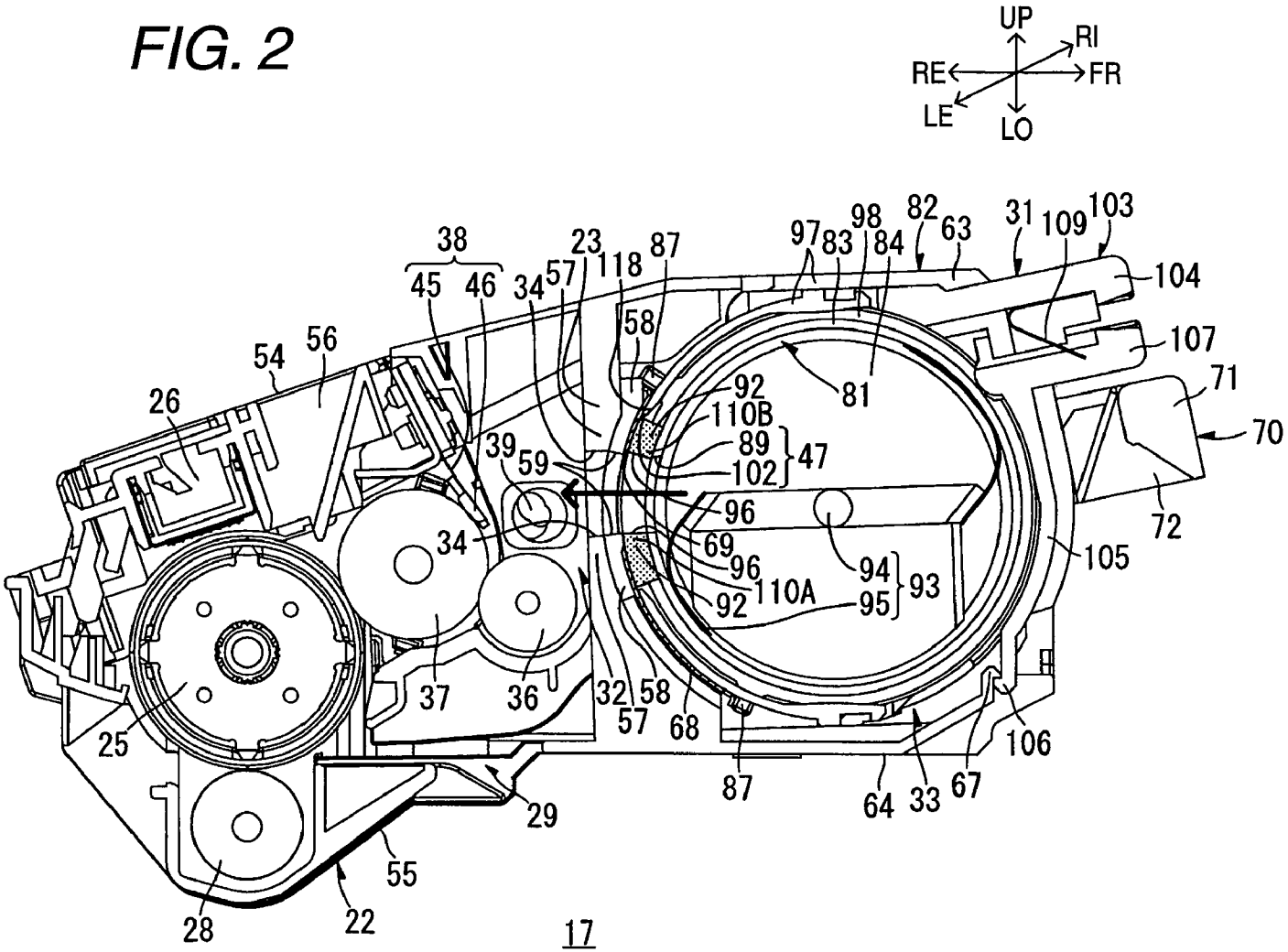
FIG. 2 is a left side sectional view of a process cartridge of the image forming apparatus shown in FIG. 1, wherein the process cartridge is in a state in which a developer cartridge is mounted and a swing arm is at a pressing position.

Referring to FIGS. 1 and 2, an image forming apparatus 1 will be described.

As shown in FIG. 1, the image forming apparatus 1 includes a feeder unit 4 for feeding sheets 3, an image forming unit 5 for forming an image on a sheet 3 so fed and a sheet discharging part 6 for discharging the sheet 3 on which the image is formed in a body casing 2 as an example of an image forming apparatus main body. Incidentally, a laser printer is one example of the image forming apparatus 1.

(1) Body Casing

The body casing 2 has a substantially box shape. The body casing 2 includes an opening in a side wall on one of sides thereof and a front cover 7 for opening and closing the opening. A process cartridge 17 (which will be described later) (an example of a developing unit) can be mounted to and removed from the body casing 2 along directions indicated by thick arrows shown in FIG. 1 by opening the front cover 7.

Note that, in the following description, the side where the front cover 7 is provided is referred to as a front side (i.e., a front elevation side) and an opposite side to the side is referred to as a rear side (i.e., a back side). In addition, a near side of FIG. 1 in a paper thickness direction is referred to as a left side, and a far side of FIG. 1 in the paper thickness direction is referred to as a right side. A left-right or transverse direction mean a width direction. A substantially horizontal direction is included in a front-rear or longitudinal direction and the transverse direction. In addition, in the description of the process cartridge 17 which will be described later and a developer cartridge 31 as an example of a developer cartridge, a state is referred to as a reference state in which frame side passage openings 34 (which will be described later) and cartridge side passage openings 47 (which will be described later) confront each other along the substantially horizontal direction (i.e., the longitudinal direction).

(2) Feeder Unit

The feeder unit 4 includes a sheet feeding tray 9, a feed roller 10, a feed pad 11, paper dust collecting rollers 12 and 13, registration rollers 14 and a sheet pressing plate 15. A sheet 3 stacked in the sheet pressing plate 15 is fed out sheet one at a time by the feed roller 10 and the feed pad 11. After passing through the various types of rollers (i.e., paper duct collecting rollers 12 and 13 and registration rollers 14), the sheet 3 is conveyed to a transfer position (which will be described later) in the image forming unit 5.

(3) Image Forming Unit

The image forming unit 5 includes a scanner unit 16, a process cartridge 17 and a fixing part 18.

(3-1) Scanner Unit

The scanner unit 16 is provided at an upper portion inside the body casing 2. The scanner unit 16 includes a laser emitting member (not shown), a polygon mirror 19 which is driven to rotate, a plurality of lenses 20 and a plurality of reflecting mirrors 21. A laser beam emitted from the laser emitting member based on image data is reflected by the polygon mirror 19, passes through the plurality of lenses 20 and is reflected by the plurality of reflecting mirrors 21 as indicated by an alternate long and short dash line, so as to be scanned over a surface of a photosensitive drum 25 (which will be described later).

(3-2) Process Cartridge

The process cartridge 17 is accommodated in a space below the scanner unit 16 in the body casing 2. The process cartridge 17 is mounted to and removed from the body casing 2.

As shown in FIG. 2, the process cartridge 17 includes a hollow process frame 22 and the developer cartridge 31. A transfer path 29 is formed in the process frame 22 for permission of passage of a sheet 3. The developer cartridge 31 is removably mounted to a cartridge holding part 33 in the process frame 22.

In the process frame 22, a partition wall 23 is provided in a substantially central position in the longitudinal direction thereof so as to extend in an up-down or vertical direction. In an inner space of the process frame 22, a portion at the rear of the partition wall 23 is referred to as a developing part 32, and a portion at the front of the partition wall 23 is referred to as the cartridge holding part 33. Frame side passage openings 34 are formed in the partition wall 23. The developing part 32 and the cartridge holding part 33 are made to communicate with each other by the frame side passage openings 34.

The developing part 32 holds the photosensitive drum 25, a scorotron-type charger 26, a transfer roller 28, a supply roller 36, a developing roller 37, a layer thickness restriction blade 38 and an auger 39. Here, the photosensitive drum 25, the transfer roller 28, the supply roller 36, the developing roller 37 and the auger 39 are supported rotatably on the process frame 22.

The scorotron-type charger 26 is supported on the process frame 22 above the photosensitive drum 25 so as to be spaced a certain interval apart from the photosensitive drum 25. The transfer roller 28 confronts the photosensitive drum 25 from a lower side of the photosensitive drum 25. The developing roller 37 confronts the photosensitive drum 25 from a front side of the photosensitive drum 25. The supply roller 36 confronts the developing roller 37 from a front side of the developing roller 37. The layer thickness restriction blade 38 includes a plate spring member 45 of a thin plate shape which is fixed to the process frame 22 at an upper end thereof and a press contact rubber 46 which presses against a surface of the developing roller 37 by virtue of an elastic force of the plate spring member 45. The auger 39 includes a shank which extends along the width direction and a spiral vane formed on an outer surface of the shank and is provided above the supply roller 36 and adjacent to the rear of the frame side passage openings 34.

The developer cartridge 31 is removably mounted to the process frame 22 and is held in the cartridge holding part 33 when so mounted. The developer cartridge 31 has a substantially cylindrical shape. Cartridge side passage openings 47 are formed in the developer cartridge 31 so as to establish a communication between an outside and an inside of the developer cartridge 31.

An agitator 93 is provided rotatably in the developer cartridge 31. In addition, positively chargeable, non-magnetic one component toner as an example of developer is accommodated in the developer cartridge 31. An average grain size (i.e., diameter) of the developer is in the range of about 6 to 10 μm.

The developer in the developer cartridge 31 is stirred by the rotating agitator 93, is received by the frame side passage openings 34 from the cartridge side passage openings 47, and is then discharged into an interior of the developing part 32. The discharged developer is conveyed in the width direction by the vane of the rotating auger 39 and is made to fall in the midst thereof so as to be supplied to the supply roller 36.

The developer supplied to the supply roller 36 is supplied to the developing roller 37 by the rotating supply roller 36. As this occurs, the developer is friction charged to a positive polarity between the supply roller 36 and the developing roller 37. Following this, the developer supplied to the developing roller 37 enters between the press contact rubber 46 and the developing roller 37 in accordance with rotation of the developing roller 37 and is carried on a surface of the developing roller 37 in the form of a thin layer while a layer thickness is being restricted between the press contact rubber 46 and the developing roller 37. Note that the developer is friction charged to the positive polarity also when it enters between the press contact rubber 46 and the developing roller 37.

In addition, firstly, the surface of the photosensitive drum 25 is uniformly charged positively by the scorotron-type charger 26 in accordance with rotation of the photosensitive drum 25 and is thereafter exposed by a laser beam from the scanner unit 16. By this series of actions, an electrostatic latent image based on image data is formed on the surface of the photosensitive drum 25. When the developer is made to confront and contact with the photosensitive drum 25 in accordance with rotation of the developing roller 37, developer carried on the surface of the developing roller 37 is supplied to the electrostatic latent image formed on the surface of the photosensitive drum 25. By this action, the electrostatic latent image is developed (i.e., visualized), and a developer image is carried on the surface of the photosensitive drum 25. The developer image is transferred on to a sheet 3 which has been supplied between the photosensitive drum 25 and the developing roller 37 (i.e., a transfer position).

(3-3) Fixing Part

As shown in FIG. 1, the fixing part 18 is provided at the rear of the process cartridge 17. The fixing part 18 includes a heating roller 18, a pressure roller 49 which is brought into press contact with the heating roller 48 from a lower side thereof, and a pair of conveyance rollers 50 provided rearward of the rollers.

In the fixing part 18, the developer transferred on to the sheet 3 in the transfer position is thermally fixed while the sheet 3 is passing through the heating roller 48 and the pressure roller 49. Thereafter, the sheet 3 is conveyed to the sheet discharging part 6 by the pair of conveyance rollers 50.

(4) Sheet Discharging Part

The sheet discharging part 6 includes a sheet discharging path 51, discharge rollers 52 and a sheet discharging tray 53. The sheet 3 conveyed from the fixing part 18 to the sheet discharging part 6 is conveyed from the sheet discharging path 51 to the discharge rollers 52 and is then discharged on to the sheet discharging tray 53 by the discharge rollers 52.

(Process Cartridge)

Referring to FIGS. 3A to 6, the process cartridge 17 will be described.

(1) Process Frame

Figures 3A, 3B:
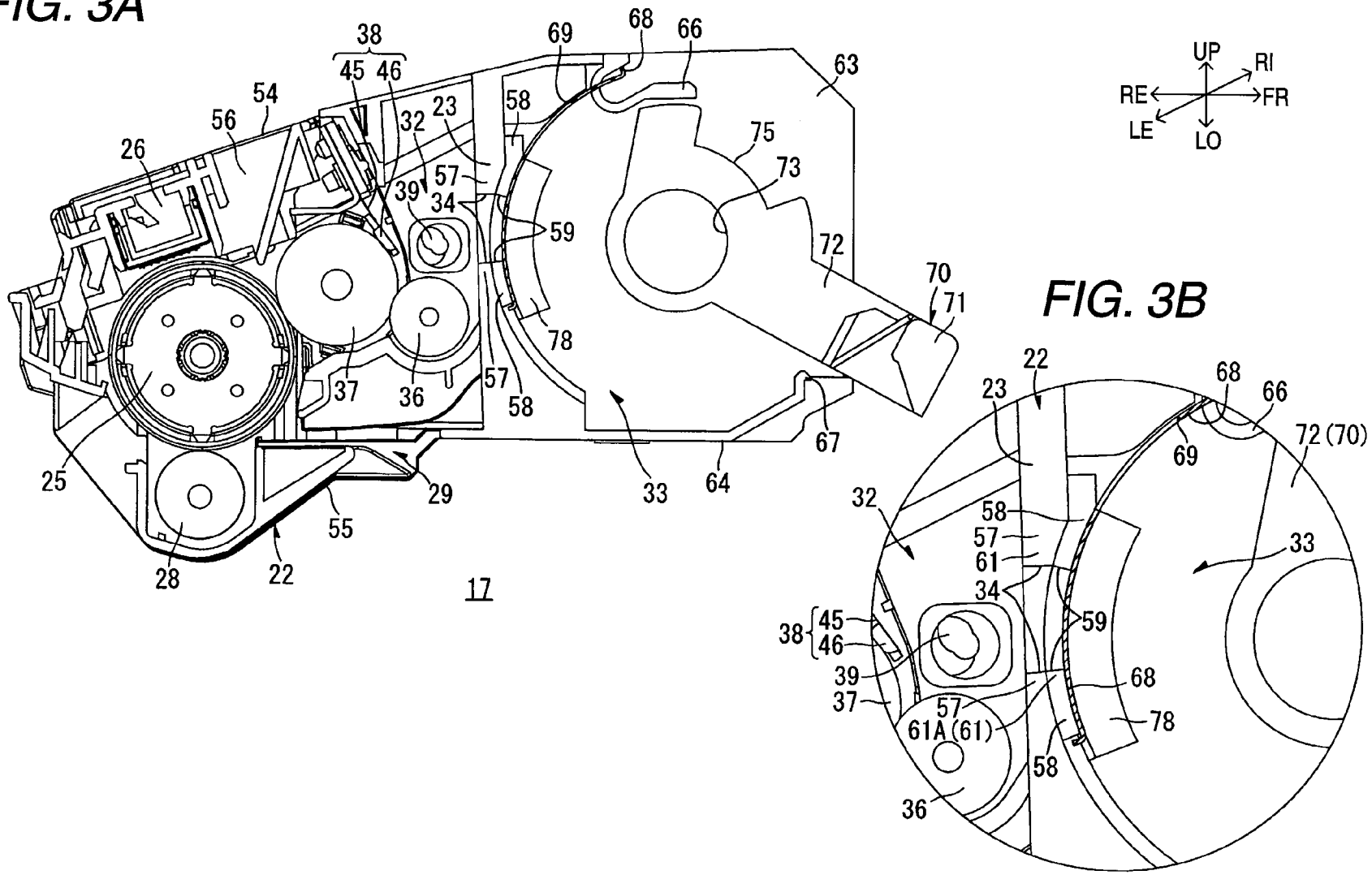
FIG. 3A is a left side sectional view of the process cartridge of the image forming apparatus shown in FIG. 1, wherein the process cartridge is in a state in which the developer cartridge is removed and a swing arm is at a pressing releasing position.
FIG. 3B is a partial enlarged view of FIG. 3A.

As shown in FIGS. 3A and 3B, the process frame 22 of the process cartridge 17 includes the developing part 32 and the cartridge holding part 33.

(1-1) Developing Part

Figure 4:
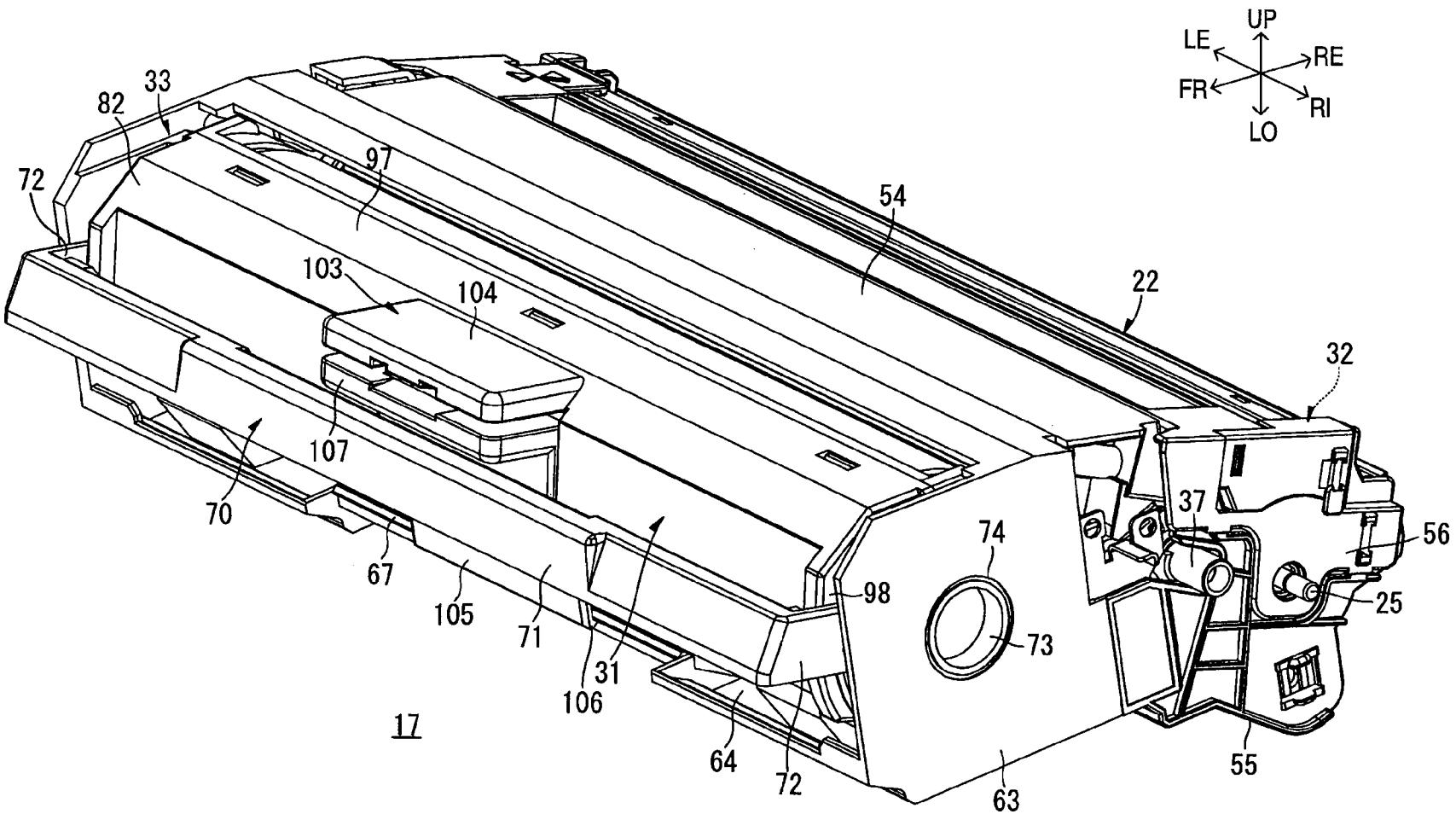
FIG. 4 is a perspective view of the process cartridge shown in FIG. 2A as viewed from a right front side.

As shown in FIGS. 3 and 4, the developing part 32 is a space defined by an upper wall 54, a bottom wall 55, both side walls 56 and the partition wall 23 that has been described above. The side walls 56 extend along the longitudinal direction. The side walls 56 confront each other with a predetermined space therebetween in the width direction.

Figure 6:
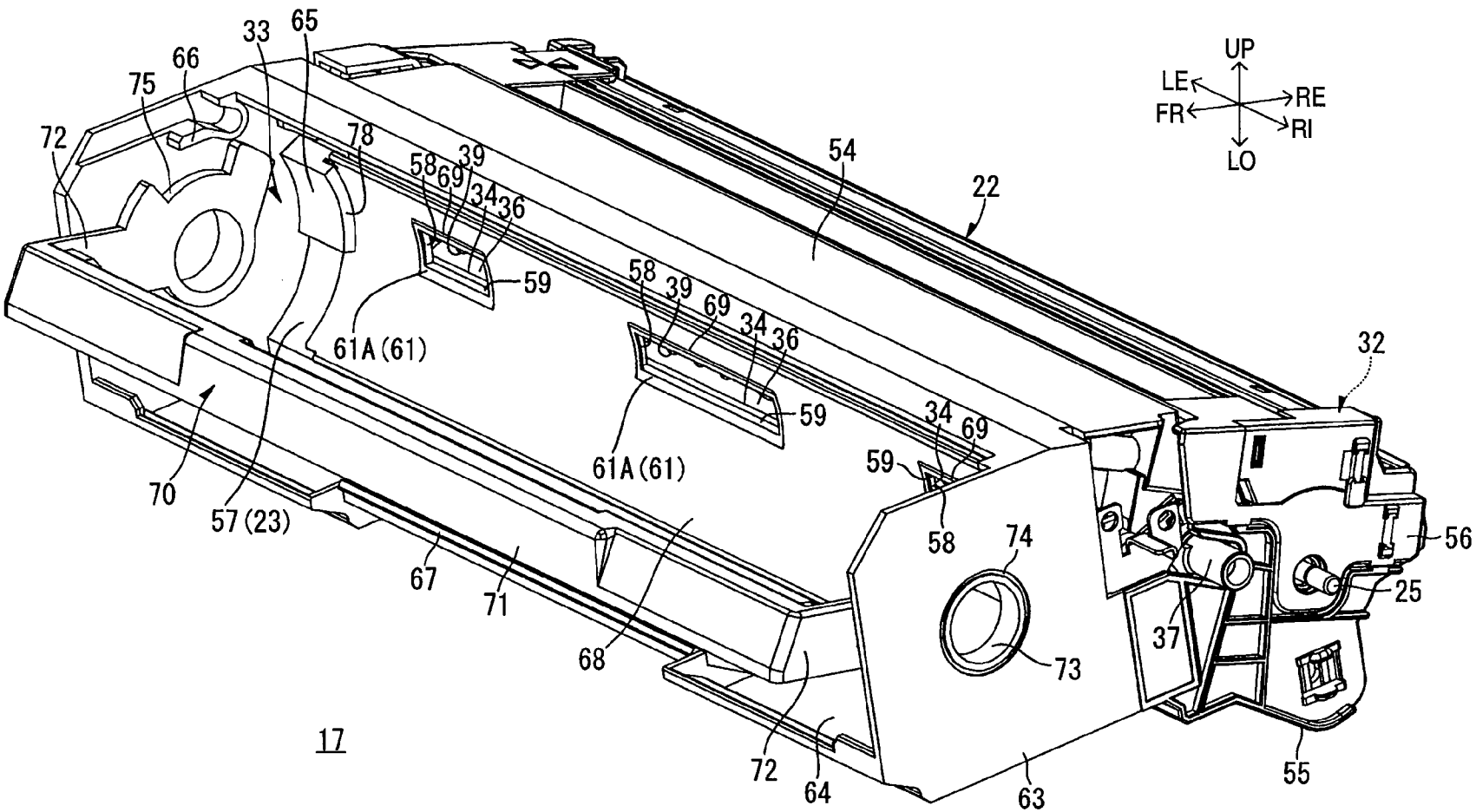
FIG. 6 is a perspective view of the process cartridge shown in FIG. 4, in which the developer cartridge is omitted.

As shown in FIG. 2, a curved portion 57 is formed halfway upwards or downwards the partition wall 23. A front surface of the curved portion 57 is smoothly recessed to the rear in such a manner as to follow an outer circumferential surface of the developer cartridge 31. The frame side passage openings 34 are formed in the curved portion 57. As shown in FIG. 6, specifically, three frame side passage openings 34 are formed at predetermined intervals in the width direction. Each frame side passage opening 34 has a substantially rectangular shape which is elongated in the width direction and is made to face the cartridge holding part 33.

As shown in FIGS. 3A and 3B, a frame seal 58 is stuck to the front surface of the curved portion 57 to prevent the leakage of developer from the frame side passage openings 34 into the cartridge holding part 33.

The frame seal 58 is made of a foamed material and has a belt-like shape which extends in the width direction. As shown in FIG. 6, three cut-out portions 59 are formed in the frame seal 58 at predetermined intervals in the width direction in such a manner as to correspond respectively to the frame side passage openings 34. Each cut-out portion 59 is a through hole having substantially the same size as the frame side passage opening 34 and is made to confront the corresponding frame side passage opening 34 from a front side thereof for communication therewith. In this state, the frame seal 58 is provided to surround the frame side passage openings 34 in such a manner that the cut-out portions 59 surround the corresponding frame side passage openings 34 while protruding towards an interior of the cartridge holding part.

(1-2) Cartridge Holding Part

Figure 5:
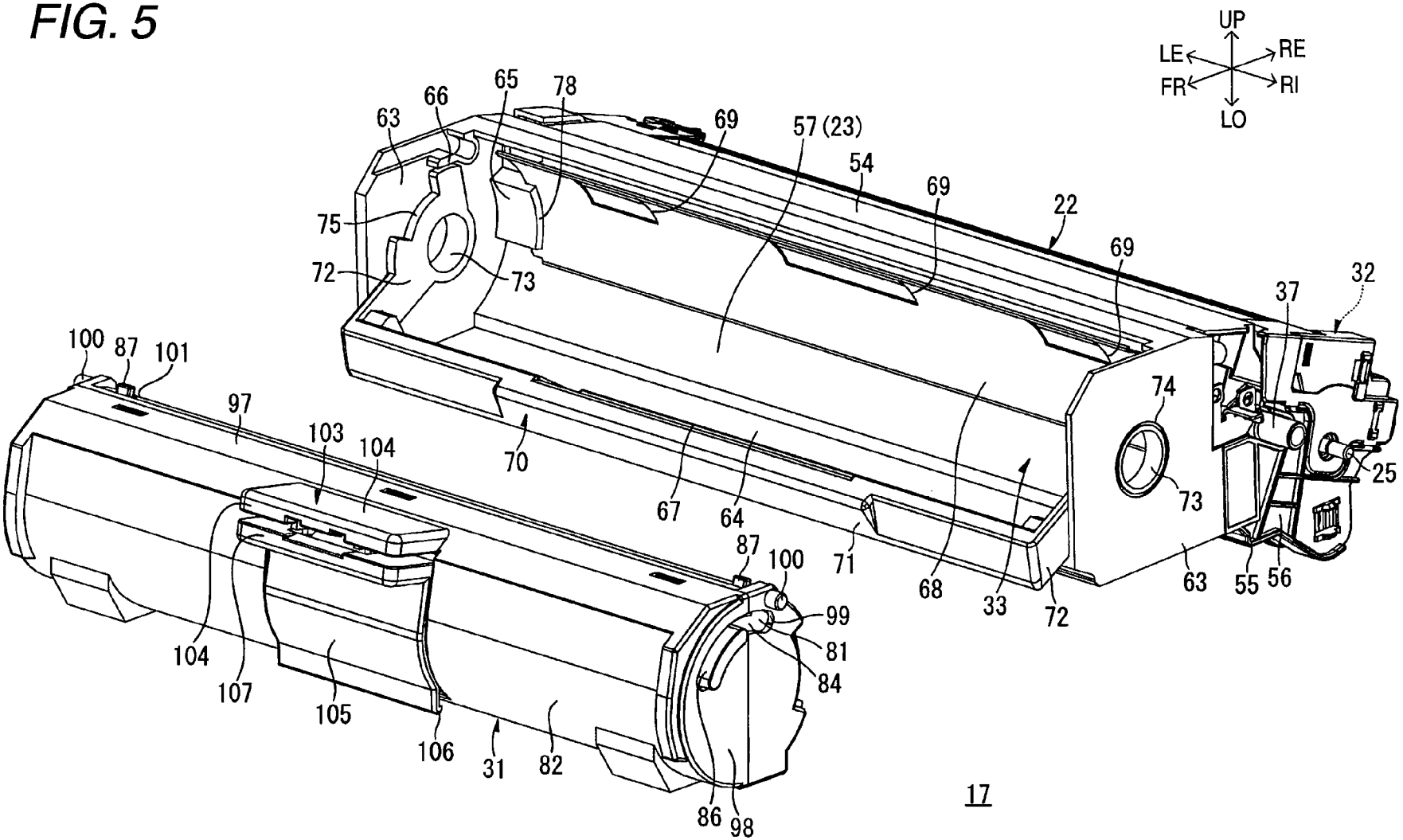
FIG. 5 is a schematic perspective view of the process cartridge as viewed from the right front side.

As shown in FIG. 5, the cartridge holding part 33 is a space defined by both side plates 63, a bottom plate 64 and the partition wall 23. The side plates 63 continue to the corresponding side walls 56 in the developing part 32, and the bottom plate 64 continues to the bottom wall 55 of the developing part 32.

A shutter supporting portion 65 is provided on an inner surface of each of the side plates 63 in the width direction. The shutter supporting portion 65 has a rectangular parallelepiped shape having an arc-like cross section when viewed from the width direction and swells inwards from the inner surface of the side plate 63 in the width direction.

A shutter guide portion 78 is provided on an inner surface of the shutter supporting portion 65 in the width direction. The shutter guide portion 78 is formed into an elongated projection which swells inwards from the inner surface of the shutter supporting portion 65 in the width direction and is provided in such a manner as to confront the curved portion 57 of the partition wall 23 with a slight space provided therebetween in the longitudinal direction. The shutter guide portion 78 has a curved shape having substantially the same radius of curvature as the curved portion 57.

An upper fixing portion 66 is provided on the inner surface of each of the side plates 63 in the width direction. The upper fixing portion 66 has a substantially U-shape which is recessed obliquely rearwards and downwards as viewed from the width direction and swells inwards from the inner surface of the side plate 63 in the width direction. A lower fixing portion 67 is formed at a center in the width direction of a front end of the bottom plate 64 in such a manner as to project slightly forwards (refer to FIG. 3A).

A shutter 68 is provided in the cartridge holding part 33 to open and close the frame side passage openings 34.

The shutter 68 has a substantially rectangular shape which extends in the width direction while having a curved shape having substantially the same radius of curvature as the curved portion 57 of the partition wall 23. The shutter 68 is formed in such a manner as to extend between the respective shutter guide portions 78 in the width direction and to extend longer then the respective shutter guide portions 78 in the vertical direction. Three shutter openings 69 are formed in the shutter 68 at predetermined intervals in the width direction in such a manner as to correspond respectively to the frame side passage openings 34.

As shown in FIGS. 3A and 3B, the shutter 68 is provided in such a manner as to confront the curved portion 57 to which the frame seal 58 is stuck from a front side of the curved portion 57, and both end portions of the shutter 68 in the width direction are held slidably between the curved portion 57 and the respective shutter guide portions 78.

By this configuration, the shutter 68 is supported in such a manner as to swing vertically along the respective shutter guide portions 78 between an opening position (refer to FIGS. 2 and 6) where the frame side passage openings 34 are opened and a closing position (refer to FIGS. 3A, 3B and 5) where the frame side passage openings 34 are closed.

To describe this in detail, a position is the closing position which is taken by the shutter 68 when the shutter 68 is moved a predetermined distance upwards from the opening position.

As shown in FIG. 2, when the shutter 68 stays in the opening position, the frame side passage openings 34 and the cut-out portions 59 are made to confront the corresponding shutter openings 69 for communication therewith and are made to open to an outside (i.e., the front side) (refer to FIG. 6). As this occurs, portions of the frame seal 58 closed to the cut-out portions 59 are compressed between the curved portion 57 of the partition wall 23 and the shutter 68 in such a manner as to surround the frame side passage openings 34 and the shutter openings 69 therebetween. By this configuration, the developer is prevented from leaking from the frame side passage openings 34 and the shutter openings 69 which are in a communicating state to a gap defined between the curved portion 57 and the shutter 68.

When the shutter 68 stays in the closing position, as shown in FIGS. 3A and 3B, the frame side passage openings 34 and the cut-out portions 59 are closed from a front side thereof by a portion of the shutter 68 which lies lower than the shutter openings 69.

In addition, as shown in FIG. 5, a wing arm 70 is provided in the cartridge holding part 33. The swing arm 70 has a substantially U-shape as viewed from the top. The swing arm 70 includes integrally a grip rod 71 which extends in the width direction and arm side plates 72 which extend rearwards from both end portions in the width direction of the grip rod 71.

A boss 73 is provided at a rear end portion of each arm side plate 72 in such a manner as to project outwards in the width direction. Each boss 73 is supported rotatably in a round hole 74 formed in the corresponding side plate 63.

In addition, a receiving recessed portion 75 is formed at an upper edge of the rear end portion of each arm side plate 72 in such a manner as to be cut out to be depressed downwards.

The swing arm 70 swings on the respective bosses 73 of the arm side plates 72 as fulcrums between a pressing releasing position (refer to FIGS. 3A and 5) where lower ends of the arm side plates 72 are brought into contact with the front end of the bottom plate 64 and a pressing position (refer to FIGS. 2, 4 and 6) where the swing arm 70 presses against the developer cartridge 31 from a front side thereof when the developer cartridge 31 is held in the cartridge holding part 33.

(2) Developer Cartridge

Referring to FIGS. 7A to 11, the developer cartridge 31 will be described.

As shown in FIGS. 7A to 11, the developer cartridge 31 includes an inside housing 81 as an example of a second frame which accommodates the developer and an outside housing 82 as an example of a first frame which accommodates the inside housing 81 (in other words, which is provided on an outside of the inside housing 81).

(2-1) Inside Housing

Figure 7B:
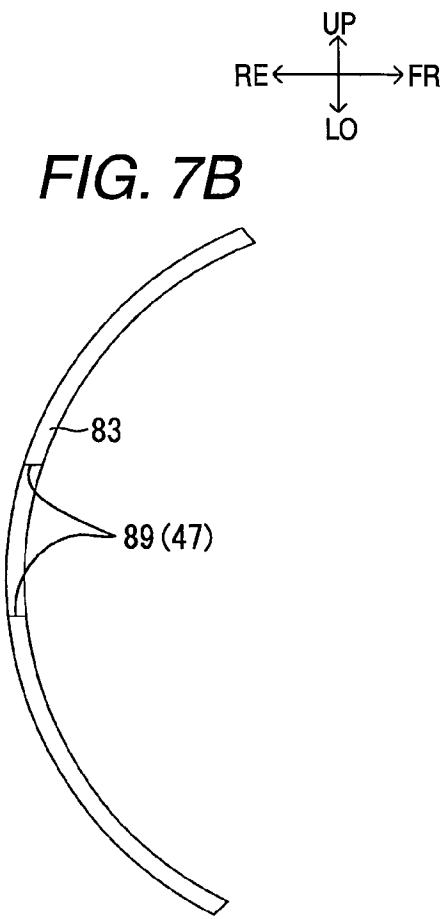
FIG. 7B is a side sectional view, at an inner passage opening, of a main part of the inside housing shown in FIG. 7A.
Figure 7A:
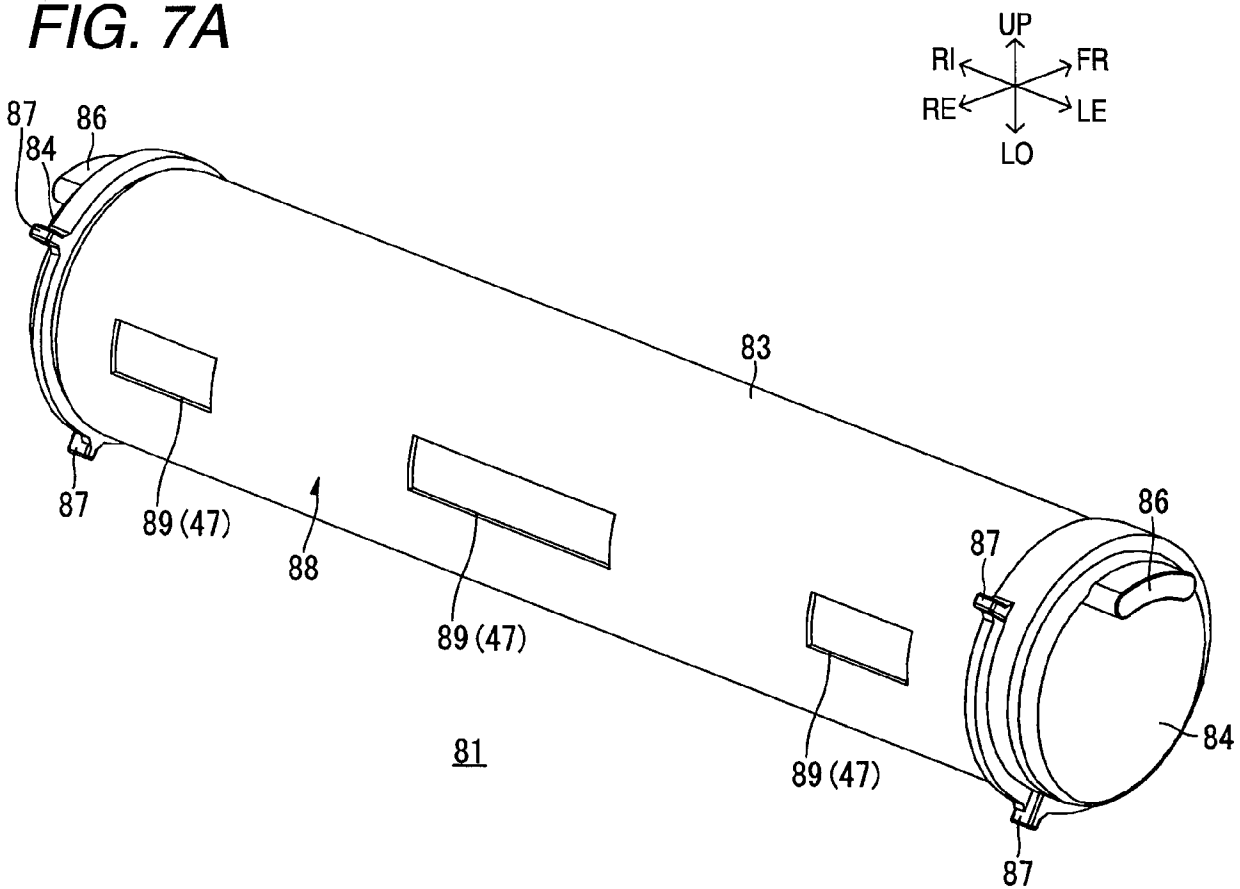
FIG. 7A is a perspective view of an inside housing of the developer cartridge as obliquely viewed from a left rear side, showing a state resulting before developer seals are stuck.

As shown in FIG. 7A, the inside housing 81 includes integrally a cylindrical inner circumferential wall 83 which extends in the width direction and a pair of disk-like inner side walls 84 which close end portions in the width direction of the inner circumferential wall 83, respectively. Hereinafter, unless mentioned particularly otherwise, the description will be made based on a state as a reference in which inner passage openings 89 as an example of openings which will be described later are oriented to the rear.

A sliding projection 86 is provided in one circumferential location (i.e., an upper end portion in FIG. 7A) on a circumferential edge portion of the inner side wall 84. The sliding projection 86 has an arc shape as viewed from a side which follows an outer circumferential surface of the inner side wall 84 and is provided in such a manner as to project outwards in the width direction from the inner side wall 84.

A pair of holding projections 87 is provided on a rear portion of the inner side wall 84 in such a manner as to project radially from a circumferential end face thereof and is provided in such a manner as to project outwards in the width direction from the inner side wall 84. The pair of holding projections 87 is provided on the circumferential end face of the inner side wall 84 in such a manner as to be spaced a predetermined distance (i.e., a distance equal to a circumferential length of the shutter 68) apart from each other in a circumferential direction.

Inner passage openings 89, which are a part of cartridge side passage openings 47, are formed in the inner circumferential wall 83 in a surrounded portion 88 which is surrounded by the pairs of holding projections 87 (i.e., four holding projections 87).

The inner passage opening 89 has a substantially rectangular shape which is elongated in the width direction as viewed from a back side thereof, and specifically speaking, three inner passage openings 89 are formed at predetermined intervals in the width direction in such a manner as to correspond respectively to the three frame side passage openings 34 (refer to FIG. 6). When a forming an image, the inner passage openings 89 are made to confront the frame side passage openings 34 (refer to FIG. 6) and the shutter openings 69 in the shutter 68 (refer to FIG. 6) which are situated in corresponding positions in the width direction.

Figure 8B:
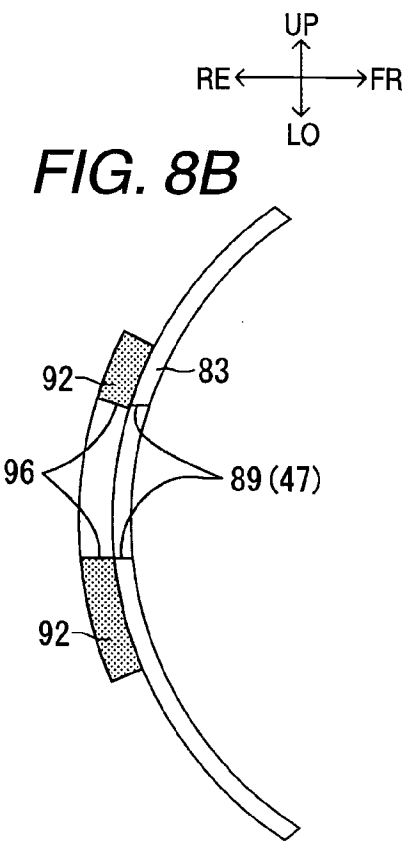
FIG. 8B shows a state in which the developer seals are stuck in FIG. 7B.
Figure 8A:
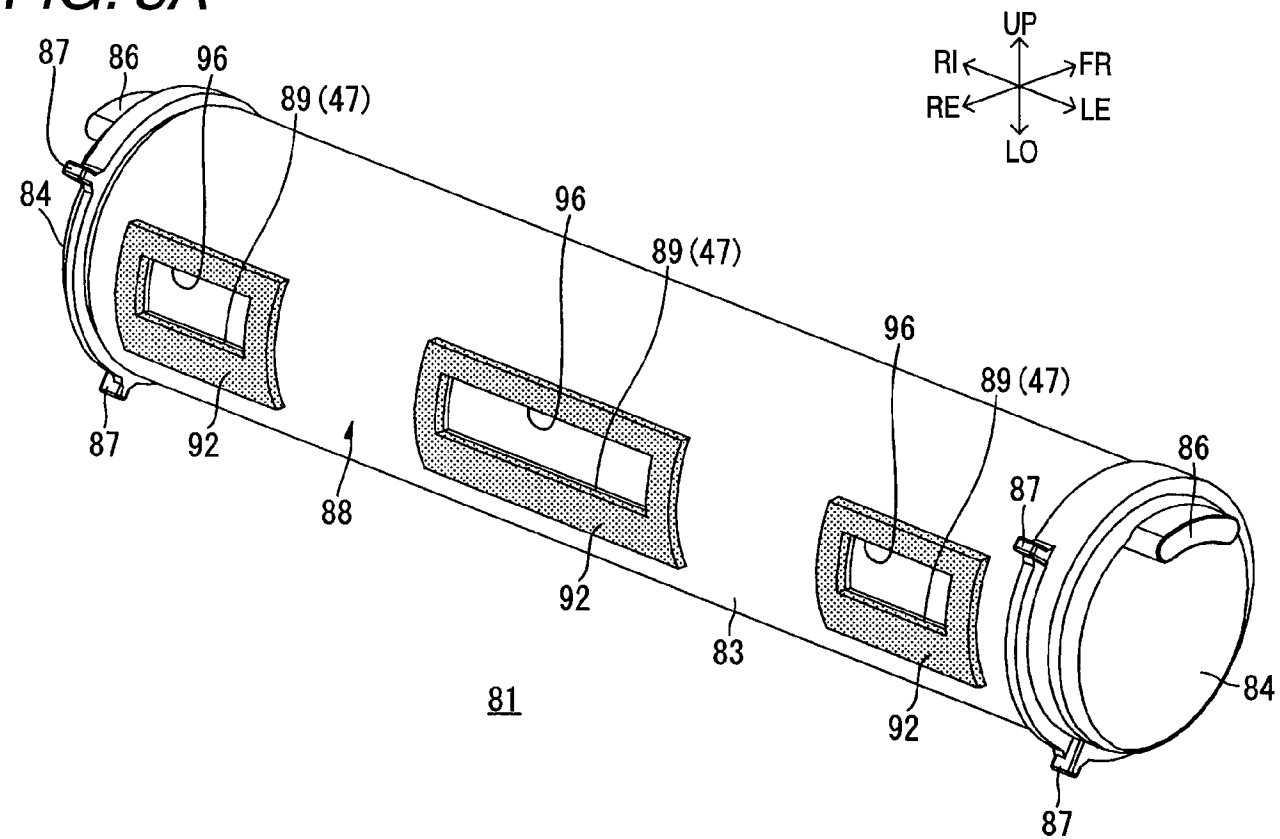
FIG. 8A shows a state in which the developer seals are stuck in FIG. 7A.

As shown in FIG. 8A, three developer seals 92 (i.e., portions shaded with dots) are stuck to an outer surface of the surrounded portion 88 in such a manner as to correspond respectively to the inner passage openings 89 for preventing the leakage of the developer from the inner passage openings 89. The developer seals 92 function as an example of a seal member. The developer seal 92 is made of a foamed material having elasticity (Poron: Trade name of the ROGERS INOAC Corporations) and has a rectangular shape which is elongated in the width direction as viewed from a back side thereof and a belt-like shape which has a substantially uniform length in the longitudinal direction (i.e., thickness).

A cut-out portion 96 is formed in a substantially central position of the developer seal 92 as viewed from the back side thereof in such a manner as to penetrate through the developer seal 92 in the longitudinal direction and to correspond to the inner passage opening 89. The cut-out portion 96 has a substantially rectangular shape as viewed from a back side thereof which has substantially the same size as that of the corresponding inner passage opening 89 and is made to confront the corresponding inner passage opening 89. In this way, the developer seals 92 are provided around the corresponding inner passage openings 89 in such a manner that the cut-out portions 96 surround respectively the corresponding inner passage openings 89 and are provided in such a manner as to project radially outwards.

As shown in FIG. 2A, the agitator 93 is provided in the inside housing 81. The agitator 93 includes an agitator shank 94 and an agitating vane 95 which extends radially outwards from the agitator shank 94. The agitator shank 94 is supported rotatably on both the inner side walls 84 and rotates by virtue of a rotational force from a motor (not shown) when forming an image.

(2-2) Outside Housing

Figure 9:
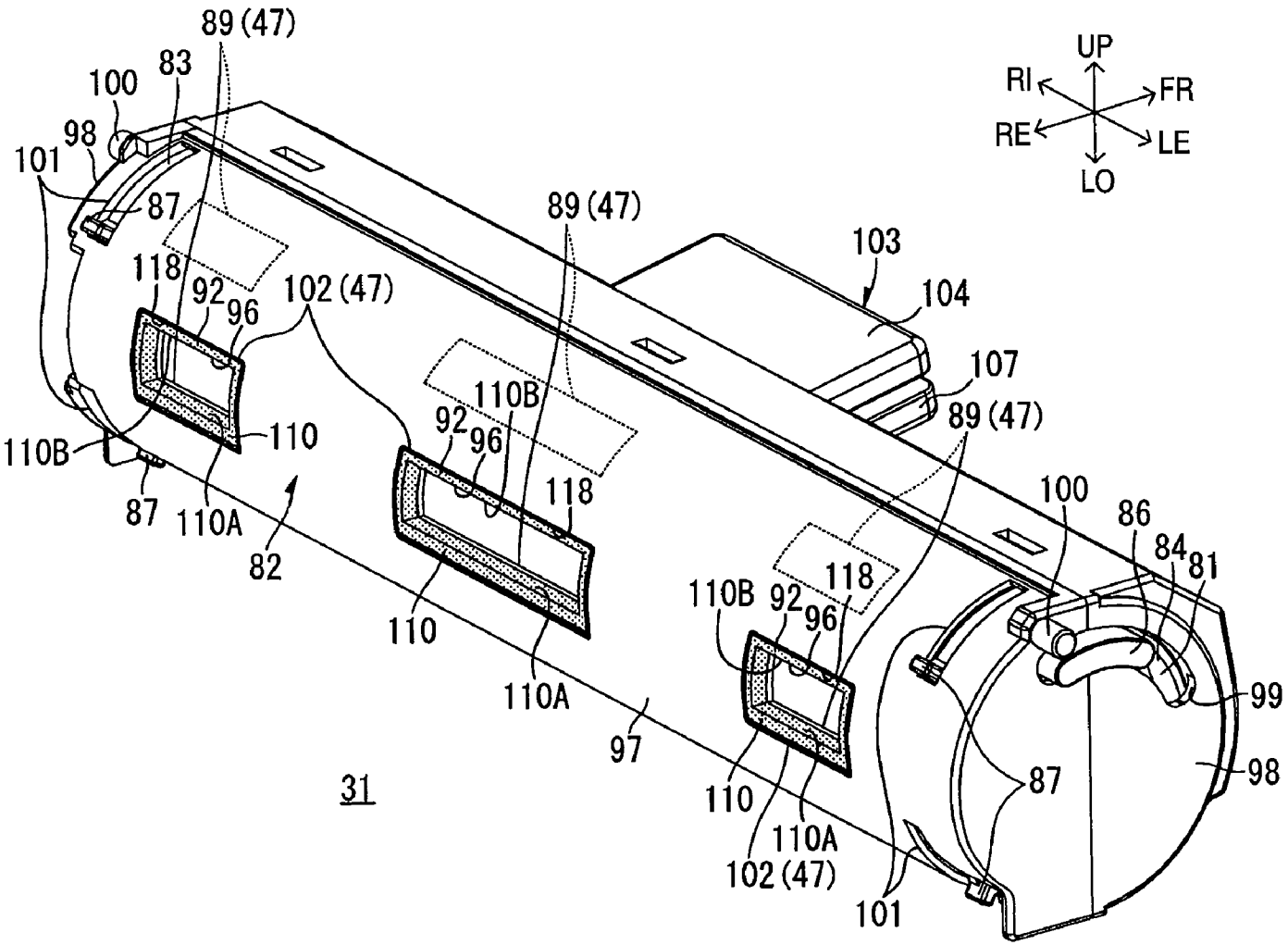
FIG. 9 is a perspective view of the developer cartridge as viewed obliquely from the left rear side, showing a state in which the inside housing is at an opening position.

The outside housing 82 is formed slightly larger in the width direction and the radial direction than the inside housing 81 so as to accommodate the inside housing 81 rotatably therein. As shown in FIG. 9, the outside housing 82 includes integrally a substantially cylindrical outer circumferential wall 97 and a pair of substantially disk-shaped outer side walls 98 which close both end portions in the width direction of the outer circumferential wall 97. Hereinafter, unless mentioned particularly otherwise, the description will be made based on a state as a reference in which outer passage openings 102 as an example of communication holes which will be described later are oriented to the rear.

Note that part, that is, an upper portion and a front upper portion of an outer circumferential surface of the outer circumferential wall 97 are formed flat, but an inner circumferential surface of the outer circumferential wall 97 has a circular cross section (refer to FIG. 2).

A slide hole into which the sliding projection 86 is inserted is formed in an upper portion of the outer side wall 98. The slide hole 99 is provided in such a manner as to confront the sliding projection 86 in the width direction. The slide hole 99 has an arc shape which is longer than the sliding projection 86 as viewed from the side thereof. A boss 100 is provided at an upper end portion of the outer side wall 98 in such a manner as to project outwards in the width direction. Four elongated holes 101 are formed in both end portions in the width direction of the outer circumferential wall 97 in such a manner that the pairs of holding projections 87 (i.e., the four holding projections 87) are inserted thereinto, respectively. Each elongated hole 101 is provided in such a manner as to confront the corresponding holding projection 87 in the radial direction. The elongated hole 101 has a substantially rectangular shape which extends in the vertical direction as viewed from a back thereof and has a length which corresponds to a swing range of the shutter 68 between the opening position and the closing position.

outer passage openings 102, which are a part of the cartridge side passage openings 47, are formed between the four elongated holes 101 (i.e., between the two upper elongated holes 101 and the two lower elongated holes 101) in the outer circumferential wall 97.

Specifically, three outer passage openings 102 are formed at predetermined intervals in the width direction in such a manner as to correspond respectively to the three inner passage openings 89 and the three frame side passage openings 34 (refer to FIG. 6). Each outer passage opening 102 has a substantially rectangular shape as viewed from a back thereof which is larger than the corresponding inner passage opening 89. When forming an image, the outer passage openings 102 are made to confront respectively to the inner passage openings 89, the cut-out portions 96 of the developer seals 92, the frame side passage openings 34 (refer to FIG. 6), the cut-out portions 59 of the frame seal 58 (refer to FIG. 6) and the shutter openings 69 in the shutter 68 (refer to FIG. 6) which are situated in the positions which correspond thereto in the width direction.

A grip portion 103 is provided on a front side of the outer circumferential wall 97. As shown in FIG. 2A, the grip portion 103 includes an upper grip plate 104 which project forwards from an upper end portion of the outer circumferential wall 97 and a locking arm 105 having a substantially J-shape as viewed from the side thereof which extends downwards below the upper grip plate 104. An upper end portion of the locking arm 105 is supported on a support shaft (not shown) provided below the upper grip plate 104 in such a manner as to swing freely. A locking claw 106 which is locked at a lower fixing portion 67 is provided at a lower end portion of the locking arm 105. A lower grip plate 107 projecting forwards is provided integrally on the locking arm 105 in a position lying in the vicinity of the upper end portion thereof. The lower grip plate 107 is provided in such a manner as to extend substantially parallel to the upper grip plate 104 with a predetermined interval provided therebetween, and a compression spring 109 is interposed between the upper grip plate 104 and the lower grip plate 107 in such a manner as to press both the plates in a direction in which the plates are spaced apart from each other.

(2-3) Relative Arrangement of Inside Housing and Outside Housing

The inside housing 81 is accommodated rotatably in the outside housing 82 and is provided in such a manner as to confront the outside housing 82 (i.e., an inner circumferential surface of the outside housing 82) in an interior of the outside housing 82.

Specifically, an outer circumferential surface of the inner circumferential wall 83 is fitted in the inner circumferential surface of the outer circumferential wall 97 in such a manner as to slide freely in the circumferential direction. To describe this in detail, the developer seals 92 which are provided on the outer circumferential surface of the inner circumferential wall 83 are in contact with the inner circumferential surface of the outer circumferential wall 97, and the developer seals 92 mainly slide relative to the inner circumferential surface of the outer circumferential wall 97. In addition, as shown in FIG. 9, the sliding projections 86 are inserted into the corresponding slide holes 99. The holding projections 87 are inserted into the corresponding elongated holes 101, and the holding projections 87 project radially outwards from the elongated holes 101.

The inside housing 81 is allowed to move (i.e., rotate) relative to the outside housing 82 between a closing position (refer to FIGS. 5 and 11) where the inner passage openings 89 and the cut-out portions 96 of the developer seals 92 do not confront the outer passage openings 102 and an opening position (refer to FIGS. 2 and 9) where the inner passage openings 89 and the cut-out portions 96 of the developer seals 92 confront the outer passage openings 102.

Figure 11:
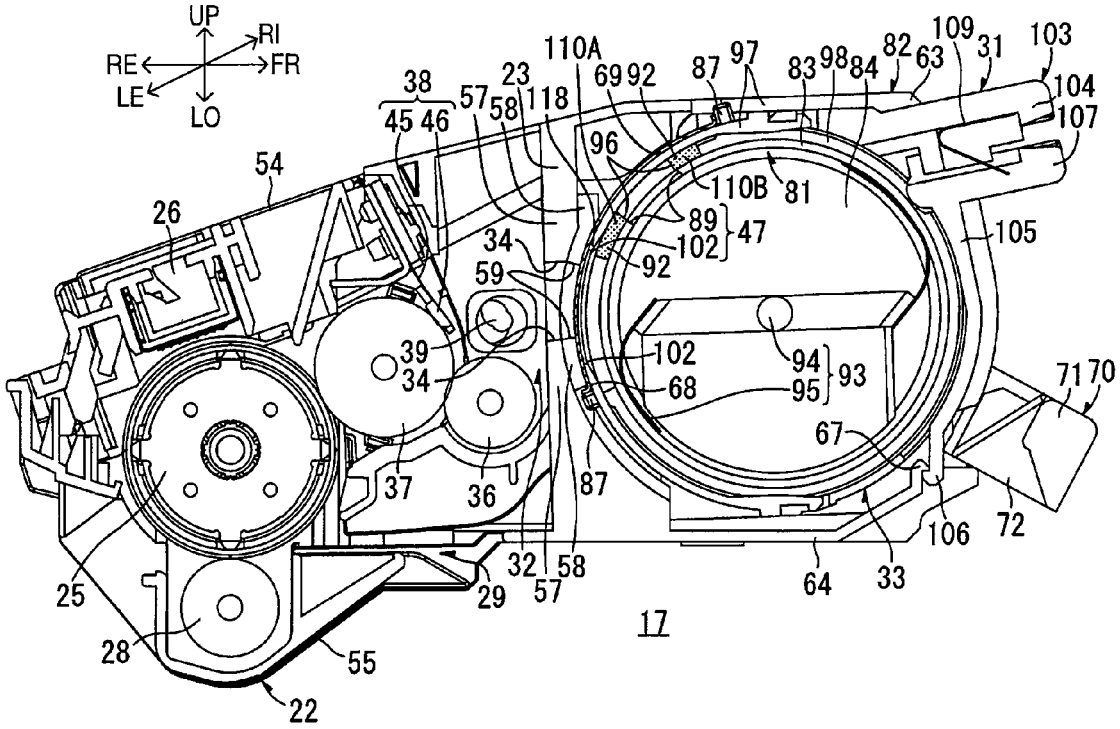
FIG. 11 shows a state in which the swing arm is in the pressing releasing position in FIG. 2.

As shown in FIG. 5, when the inside housing 81 stays in the opening position, the sliding projections 86 are provided at front end portions of the corresponding slide holes 909, and the holding projections 87 are provided at upper end portions of the corresponding elongated holes 101. In addition, as indicated by broken lines in FIG. 9 and as also shown in FIG. 11, the inner passage openings 89 are provided further upwards than the outer passage openings 102, and the outer passage openings 102 are closed from a radially inside thereof by portions of the inner circumferential wall 83 which lie further downwards than the inner passage openings 89 (i.e., portions indicated by the broken lines in FIG. 9). To describe this in a reverse fashion, the inner passage openings 89 are closed from an outside thereof by portions of the outer circumferential wall 97 which lie further upwards than the outer passage openings 102. Here, as shown in FIG. 11, the developer seals 92 are compressed between the inner circumferential wall 83 and the outer circumferential wall 97.

In addition, when the inside housing 81 is caused to rotate relative to the outside housing 82 in a direction in which the inner passage openings 89 move towards the outer passage openings 102, and the inner passage openings 89 and the cut-out portions 96 come to confront the outer passage openings 102, the inside housing 81 is provided in the opening position.

When the inside housing 81 is provided in the opening position, as shown in FIG. 9, the sliding projections 86 are provided at rear end portions of the corresponding slide holes 99, and the holding projections 87 are provided at lower end portions of the corresponding elongated holes 101. In addition, the inner passage openings 89 and the cut-out portions 96 are made to confront the corresponding outer passage openings 102 for communication therewith. Therefore, all the inner passage openings 89, the cut-out portions 96 and the outer passage openings 102 are made to open to each other.

When the inside housing 81 is provided in the opening position, the respective developer seals 92 are exposed from the corresponding outer passage openings 102.

As described above, the inside housing 81 moves upwards from the opening position to the closing position relative to the outside housing 82, while the inside housing 81 moves downwards from the closing position to the opening position relative to the outside housing 82 (refer to FIGS. 2, 9, 11). By virtue of the relative movement between the inside housing 81 and the outside housing 82, the inner passage openings 89 are opened and closed by the outside housing 82.

(3) Mount and Removal of Developer Cartridge to and from Process Frame (3-1) Mount of Developer Cartridge to Process Frame When mounting the developer cartridge 31 to the process frame 22, the upper grip plate 104 and the lower grip plate 107 are held together in a direction in which the grip plates approach each other against a pressing force of the compression spring 109 (refer to FIG. 2) as shown in FIG. 5. Then, the developer cartridge 31 (i.e., the developer cartridge 31 in which the inside housing 81 is provided in the closing position) is mounted to the cartridge holding part 33 (i.e., the developer cartridge holding part 33 in which the shutter 68 is provided in the closing position, and the swing arm 70 is provided in the pressing releasing position).

By the series of actions, the developer cartridge 31 is placed on the bottom plate 64. As this occurs, the bosses 100 are received by the corresponding fixing portions 66, the sliding projections 86 are fitted in the corresponding receiving recessed portions 75, and as shown in FIG. 2A, the pairs of holding projections 87 which are provided on both the ends in the width direction of the developer cartridge 31 are made to hold upper ends and lower ends of both the end portions in the width direction of the shutter 68. By this action, the inside housing 81 having the sliding projections 86 and the holding projections 87 are brought into engagement with the swing arm 70 and the shutter 68, respectively.

Thereafter, the holding of the upper grip plate 104 and the lower grip plate 107 is released, the locking arm 105 swings by virtue of the pressing force of the compression spring 109, the locking claw 106 is locked at the lower fixing portion 67, and the developer cartridge 31 is accommodated in the cartridge holding part 33, so as to be held by the cartridge holding part 33.

By the bosses 100 being received by the upper fixing portions 66 and the locking claw 106 being locked at the lower fixing portion 67, the outside housing 82 is fixed by the cartridge holding part 33. As this occurs, as shown in FIG. 11, the frame side passage openings 34 and the corresponding cartridge side passage openings 47 (specifically, the outer passage openings 102) confront each other in the longitudinal direction across the shutter 68 which stays in the closing position.

Then, the swing arm 70 is swung from the pressing releasing position to the pressing position. By this action, the sliding projections 86 which are fitted in the corresponding receiving recessed portions 75 (refer to FIG. 5) slide rearwards in the corresponding slide holes 99 so as to be provided at the rear end portions of the sliding holes 99 as the swing arm 70 swings (refer to FIG. 9). In accordance with this, the pairs of holding projections 87 provided at both the ends in the width direction slide downwards in the corresponding elongated holes 101 while holding the shutter 68 therebetween, so as to be provided at the lower end portions of the elongated holes 101 (refer to FIG. 9).

By this action, the inside housing 81 is provided in the opening position. Thus, as shown in FIGS. 2 and 9, the inner passage openings 89 and the cut-out portions 96 of the developer seals 92 are made to confront the corresponding outer passage openings 102 in the substantially horizontal direction. Therefore, the inner passage openings 89 and the cut-out portions 96 are allowed to communicate with the outer passage openings 102. In addition, the shutter 68, which is in engagement with the inside housing 81, moves together with the inside housing 81 so as to be provided in the opening position, and the frame side passage openings 34 and the cut-out portions 59 of the frame seal 58 are made to confront the corresponding shutter openings 69 and cartridge side passage openings 47 (i.e., including the inner passage openings 89, the cut-out portions 96 and the outer passage openings 102 which are in the communicating state therewith) in the substantially horizontal direction. Accordingly, the frame side passage openings 34 and the cut-out portions 59 are allowed to communicate with the shutter openings 69 and the cartridge side passage openings 47.

In addition, as shown in FIG. 2, when both the inside housing 81 and the shutter 68 are in the opening positions, the respective developer seals 92 which project radially to the outside of the outer circumferential wall 97 project rearwards in such a manner as to surround the corresponding shutter openings 69 without any gap provided therebetween.

Since the gaps between the inner passage openings 89 and the frame side passage openings 34 are surrounded by the frame seals 58, the developer seals 92 and the shutters 68 without any gap provided therebetween, the leakage of developer between the inner passage openings 89 and the frame side passage openings 34 can be prevented.

When an image is formed, developer accommodated in the interior of the inside housing 81 passes through the inner passage openings 89, the cut-out portions 96 of the developer seals 92, the outer passage openings 102, the shutter openings 69, the cut-out portions 59 of the frame seal 58 and the frame side passage openings 34 along the substantially horizontal direction as indicated by a thick arrow shown in FIG. 2B by agitation by the agitator 93, so as to be supplied to the interior of the developing part 32. Namely, the inner passage openings 89 are opened, and the passage of the developer at the inner passage openings 89 is permitted.

Incidentally, the developer may be circulated between the developing part 32 and the developer cartridge 31. As this occurs, the developer accommodated in the developer cartridge 31 is supplied into the interior of the developing part 32 via the cartridge side passage opening 47 (refer to FIG. 9) and the frame side passage opening 34 (refer to FIG. 6) which are situated in the center in the width direction. The supplied developer is then supplied to the supply roller 36 while being conveyed towards both ends in the width direction of the developing part 32 by the auger 39. While the developer is being so supplied, part of the developer is returned to the interior of the developer cartridge 31 via the frame side passage openings 34 and the cartridge side passage openings 47 which are situated at both the ends in the width direction of the cartridge holding part 33 and the developer cartridge 47, respectively.

(3-2) Removal of Developer Cartridge from Process Frame

To remove the developer cartridge 31 from the process frame 22, firstly, the swing arm 70 is swung from the pressing position (refer to FIG. 2A) to the pressing releasing position (refer to FIG. 3A).

Referring to FIG. 5, when the swing arm 70 is swung from the pressing position to the pressing releasing position, the sliding projections 86 which are fitted in the receiving recessed portions 75 start sliding to the front in the corresponding slide holes 99 as the side arm plates 72 swing. In response hereto, the inside housing 81 starts moving from the opening position to the closing position, and the pairs of holding projections at both the ends in the width direction of the inside housing 81 shown in FIG. 2 start sliding upwards in the corresponding elongated holes 101 while holding the shutter 68 therebetween.

Figure 10:
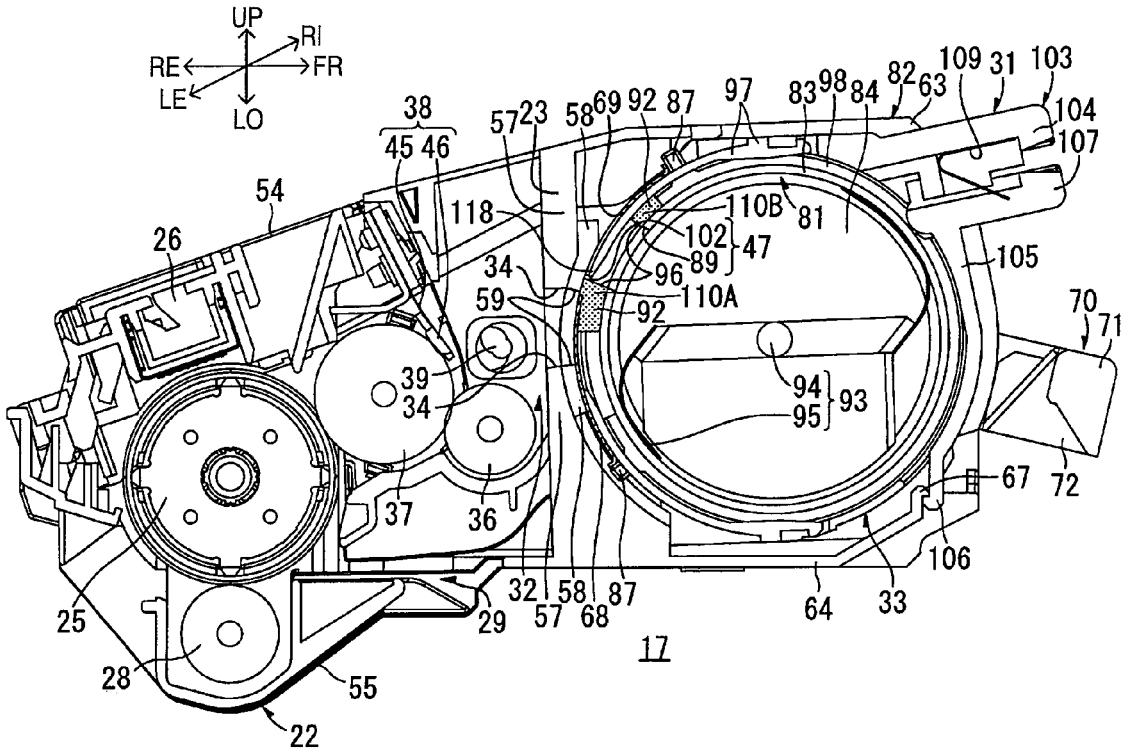
FIG. 10 shows a state in which the swing arm is positioned between the pressing position and the pressing releasing position in FIG. 2.

When the inside housing 81 moves further towards the closing position, the upper circumferential edge portions 110B and the lower circumferential edge portions 110A of the developer seals 92 are sequentially brought into contact with portions on the outer circumferential wall 97 which comprise upper circumferential edges of the outer passage openings 102 (referred to as upper contact portions 118) and then enter between the outer circumferential wall 97 and the inner circumferential wall 83 while the upper circumferential edge portions 110B and the lower circumferential edge portions 110A are being compressed towards the inner circumferential wall 83 side (refer to FIGS. 2, 10 and 11).

In addition, referring to FIG. 5, when the inside housing 81 moves towards the closing position, the sliding projections 86 are provided at the front end portions of the corresponding slide holes 99, and the pairs of holding projections 87 at both the ends in the width direction of the inside housing 81 slide upwards in the corresponding elongated holes 101 while holding the shutter 68 therebetween so as to be provided at the upper end portions of the elongated holes 101.

Thus, as shown in FIG. 11, the inside housing 81 is provided in the closing direction, and the outer passage openings 102 and the inner passage openings 89 are closed. By closing the inner passage openings 89, the passage of the developer at the inner passage openings 89 is restricted. In addition, the shutter 68 which is in engagement with the inside housing 81 moves together with the inside housing 81 so as to be provided in the closing position, the frame side passage openings 34 and the cut-out portions 59 in the frame seal 58 are made to confront the shutter 68 to thereby be closed (refer to FIGS. 3A and 3B).

Then, when the upper grip plate 104 and the lower grip plate 107 are held in the direction in which they approach each other, the locking of the locking claw 106 to the lower fixing portion 67 is released. Thus, as shown in FIG. 5, in the event that the developer cartridge 31 is pulled forwards from the cartridge holding part 33 in that state, the sliding projections 86 are disengaged from the corresponding receiving recessed portions 75, and the holding projections 87 are disengaged from the shutter 68. By the series of actions, the engagement of the inside housing 81 with the swing arm 70 and the shutter 68 is released individually, and the developer cartridge 31 is removed from the process frame 22.

(Developer Seal)

Figures 12A, 12B, 12C:
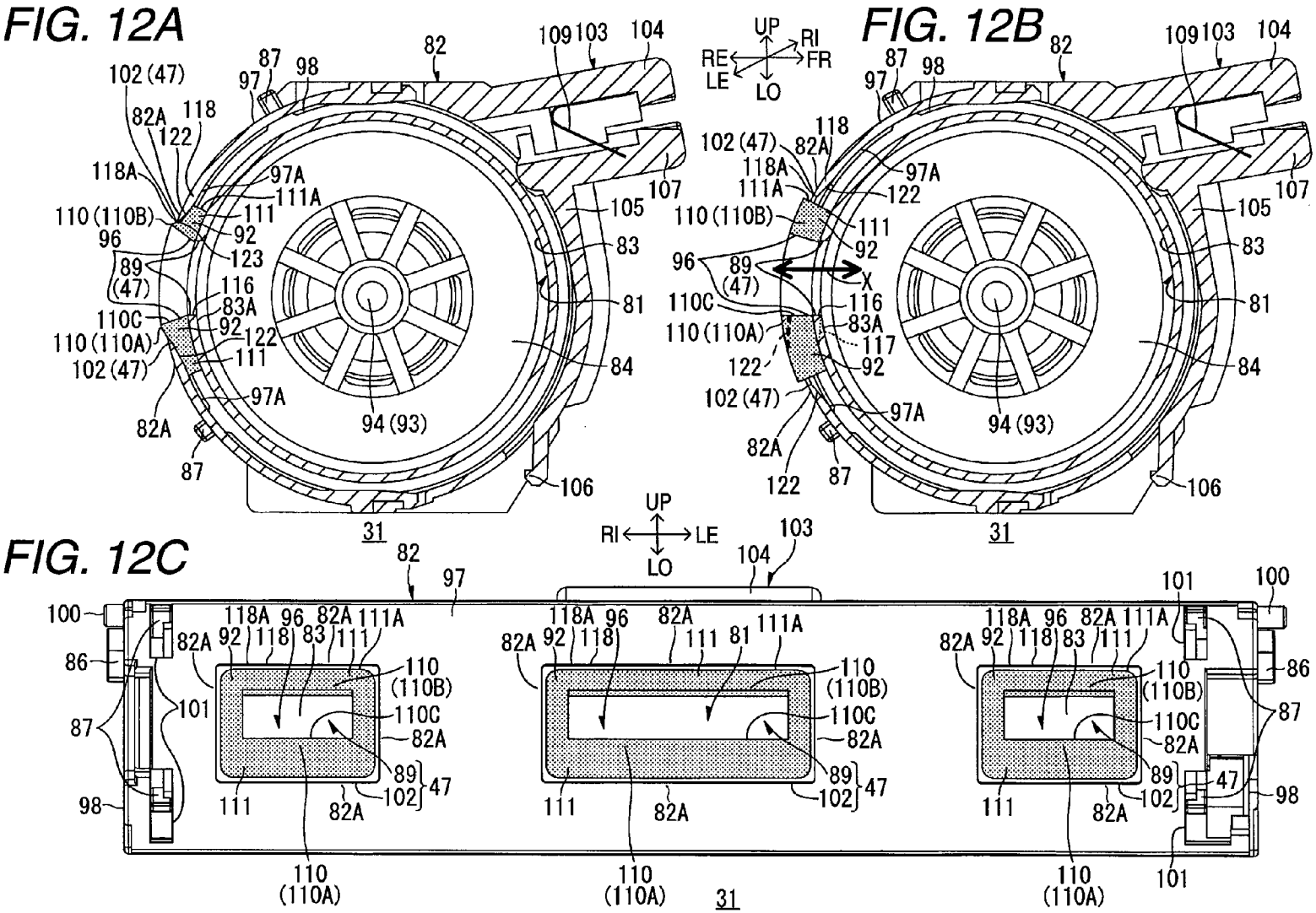
FIG. 12A is a left side sectional view of a developer cartridge according to a reference example, showing a state in which an inside housing is at an opening position.
FIG. 12B is a left side sectional view of the developer cartridge wherein a first and a second examples are applied to FIG. 12A.
FIG. 12C is a rear view of the developer cartridge shown in FIG. 12B.

Referring to FIGS. 12A to 12C, examples of the developer seal 92 will be described.

(1) Reference Example

FIG. 12A is a left side sectional view of a developer cartridge according to a reference example.

As shown in FIG. 12A, in a developer cartridge 31 according to the reference example, when an inside housing 81 is provided in an opening position, inner circumferential edge portions 110 of respective developer seals 92 project radially outwards such that radial outer surfaces of the inner circumferential edge portions 110 become substantially level with an outer surface of an outer circumferential wall 97. In addition, in each developer seal 92, an outer circumferential edge portion 111 other than the inner circumferential edge portion 110 is compressed between the outer circumferential wall 97 and an inner circumferential wall 83 so as to surround a corresponding inner passage opening 89. That is, in this state, a stepped portion is formed on the developer seal 92 at a boundary 123 between the inner circumferential edge portion 110 and the outer circumferential edge portion 111.

In this case, in the developer seal 92, the inner circumferential edge portion 110 deforms (i.e., distorts) to an unnecessary extent by being affected by the formation of the stepped portion at the boundary 123, and the developer seal 92 may not surround an shutter opening portion 69 in the shutter 68 without any gap provided therebetween. That is, in the inner circumferential edge portion 110, a lower circumferential edge portion 110A is not brought into full press contact with a lower circumferential edge portion 61A (refer to FIG. 6) of an inner circumferential edge portion 61 of a frame seal 58, and an upper circumferential edge portion 110B is not brought into full press contact with the shutter 68 (i.e., an upper portion of the shutter 68 than the shutter opening portion 69). As this occurs, the leakage of the developer between the inner passage opening 89 and a frame side passage opening 34 may not be prevented.

Namely, in the reference example, the developer seal 92 may deform to an unnecessary extent, and the developer may be leaked in a location on the developer seal 92 where such a deformation is occurring (i.e., the inner circumferential edge portion 110).

(2) First Example

Referring to FIGS. 12B and 12C (specifically, FIG. 12C), the developer cartridge 31 according to a first example will be described.

As shown in FIGS. 12B and 12C, in a state where an inner passage opening 89 is opened (i.e., a state in which the inside housing 81 is in an opening position), a whole developer seal 92 is provided in a position which is different from a position where the developer seal 92 overlaps an outside housing 82 (i.e., a position where the developer seal 92 does not overlap the outside housing 82) when projected from a developer passage direction X (which is substantially a longitudinal direction, refer to a thick solid line having arrows at both ends thereof in FIG. 12B) at the inner passage opening 89.

Specifically, as shown in FIG. 12C, when projected from the developer passage direction X (i.e., the substantially longitudinal direction), the whole developer seal 92 is provided in a position that differs from a position where the developer seal 92 overlaps a portion on the outside housing 82 bounding an outer passage opening 102 (i.e., a portion where the developer seal 92 does not overlap an outer circumferential edge portion 82A). Thus, the developer seal 92 is exposed from the outer passage opening 102. Namely, the whole developer seal 92 (i.e., a front surface and top, bottom, left and right end faces of the developer seal 92) is exposed in an area surrounded by the circumferential edge portion 82A.

Thus, in contrast to the reference example (refer to FIG. 12A), there exists on the developer seal 92 no portion which is compressed between an outer circumferential wall 97 and an inner circumferential surface 83 (refer to FIG. 12B) when an inner passage opening 89 is opened.

Namely, in a state where the inner passage opening 89 is opened, the developer seal 92 is exposed completely from the outer passage opening 102 without being brought into contact with the circumferential edge portion 82A on the outside housing 82 which bounds the outer passage opening 102. Therefore, the developer seal 92 can be prevented from being deformed by contact with the outside housing 82.

In this state, the developer seal 92 projects further outwards than an outer surface of the outside housing 82 (specifically, the outer circumferential wall 97) (refer to FIG. 12B). Thus, the developer seal 92 contacts closely an exterior member (i.e., the above-described shutter 68 or the like) to which the developer is supplied thereto from the developer cartridge 31 so as to prevent the leakage of the developer between the exterior member and the inner passage opening 89.

(3) Second Example

Referring to FIG. 12B, the developer cartridge 31 according to a second example will be described.

As shown in FIG. 12B, in the developer seal 92, when the inside housing 81 moves relative to the outside housing 82 from an opening position to a closing position, an upper end face 110C of a lower circumferential edge portion 110A and an upper end face 111A of an outer circumferential portion 111 both come to confront an upper contact portion 118 of the outside housing 82 (i.e., a portion on the outer circumferential wall 97 which configures an upper circumferential edge of the outer passage opening 102) from the below for contact therewith. Here, the upper contact portion 118 functions as an example of a first frame side confronting portion. The upper end face 110C of the lower circumferential edge portion 110A and the upper end face 111A of the outer circumferential edge portion 111 of the developer seal 92 function as an example of a seal side confronting portion.

In the second example, the upper contact portion 118 of the outside housing 82 includes an inclined surface 122. Specifically, the inclined surface 122 of the upper contact portion 118 is connected to a lower end face 118A of the upper contact portion 118 and an inner circumferential surface 97A of the outer circumferential wall 97 while intersecting them.

By providing the inclined surface 122 on the upper contact portion 118, when the inside housing 81 moves to the closing position relative to the outside housing 82, the upper end face 110C of the lower circumferential edge portion 110A of the developer seal 92 can be brought into contact with the upper contact portion 118 of the outside housing 82 in a moderate fashion on the inclined surface 122 of the upper contact portion 118. Therefore, even though the upper end face 110C and the upper contact portion 118 are made to contact each other, the developer seal 92 can be prevented from being damaged on the upper end face 110C thereof.

Similarly, when the inside housing 81 moves to the closing position relative to the outside housing 82, the upper end face 111A of the outer circumferential edge portion 111 of the developer seal 92 can be brought into contact with the upper contact portion 118 of the outside housing 82 in a moderate fashion on the inclined surface 122 of the upper contact portion 118, thereby making it possible to prevent the developer seal 92 from being damaged on the upper end face 111A.

In addition, the upper end face 110C of the lower circumferential edge portion 110A of the developer seal 92 is brought into contact with the upper contact portion 118 of the outside housing 82 in a moderate fashion on the inclined surface 122 of the upper contact portion 118. Thus, in a case where the outside housing 82 is provided on the outside of the inside housing 81, when the inside housing 81 moves to the closing position relative to the outside housing 82, the developer seal 92 can move into an inside of the outside housing 82 smoothly without being caught on the outside housing 82 (i.e., the upper contact portion 118) on the upper end face 110C thereof.

Similarly, the developer seal 92 can move into the inside of the outside housing 82 smoothly without being caught on the outside housing 82 (i.e., the upper contact portion 118) on the upper end face 111A of the outer circumferential edge portion 111 thereof.

Specifically, even though the developer seal 92 project further outwards than the outer surface of the outer circumferential wall 97 in such a state that the inside housing 81 is in the opening position, when the inside housing 81 moves to the closing position relative to the outside housing 82, the developer seal 97 can move into the inside of the outside housing 82 smoothly without out being caught on the upper housing 82 (i.e., the upper contact portion 118) both on the upper end face 110C and the upper end face 111A.

The inclined surface 122 may also be formed on the portions (i.e., the upper end face 110C of the lower circumferential edge portion 110A and the upper end face 111A of the outer circumferential edge portion 111) on the developer seal 92 which confront and contact the outside housing 82 (i.e., the upper contact portion 118) (for example, refer to an inclined surface 122 shown by a thick broken line at the lower circumferential edge portion 110A in FIG. 12B). Here, for example, in the event that a rear portion of a lower circumferential portion 116 (i.e., a portion which configures a lower circumferential edge of the inner passage opening 89) of the inner circumferential wall 83 is chamfered (refer to a chamfered portion 117 shown by a broken line in FIG. 12B), when the developer seal 92 is stuck, an inclined surface similar to the above-described inclined surface 122 is naturally formed on the upper end face 110C of the lower circumferential edge portion 110A of the developer seal 92.

Incidentally, although both of the first example and the second example are applied to FIGS. 12B and 12C, each of the first example and the second example may be applied separately.

Modification to Exemplary Embodiments (1) Modified Example 1

In the above-described exemplary embodiment, as shown in FIG. 1, the process cartridge 17 integrally has the photoconductive drum 25 and the development roller 37, and the process cartridge 17 is removably mounted in the body casing 2. Alternatively, the process cartridge 17 may be configured such that the developer cartridge is not provided with the photoconductive drum 25, while another unit (i.e., drum cartridge) having the photoconductive drum 25 is provided, to removably mount the developer cartridge to the drum cartridge. Still alternatively, only the developer cartridge 31 may be configured to be removable in a state in which the process cartridge 17 is kept mounted in the body casing 2.

Further, the body casing 2 may include the photoconductive drum 25, the scorotron-type charger 26, and the transfer roller 28, and the developer cartridge may be removably mounted in that body casing 2. In such a configuration, the developer cartridge 31 is removably mounted to the developing cartridge, and a shutter 68 is provided in the developing cartridge.

(2) Modified Example 2

Although exemplary embodiments of the present inventive concept have been described in relation to a laser printer, the present inventive concept is not limited to a monochrome laser printer. Rather, the present inventive concept can also be applied to a color laser printer, including a tandem type and an intermediate transfer type printer.

(3) Modified Example 3

In the above-described exemplary embodiments, the inside housing 81 is accommodated in the outside housing 82, and the inside housing 81 is made to rotate between the opening position and the closing position, so that the inner passage openings 89 formed in the inside housing 81 are opened and closed.

The outside housing 82 is configured to have a hollow body shape. Alternatively, the outside housing 82 may be configured to have a plate shape, which is similar to the shutter 68 (refer to FIGS. 2 and 6).

According to another aspect of the invention, in the developer cartridge, wherein the first frame comprises a communication hole that communicates with the opening when the opening is opened, and wherein the seal member does not overlap a portion of the first frame that bounds the communication hole so as to be exposed from the communication hole as viewed from the direction in which the developer passes the opening when the opening is opened.

According thereto, since the communication hole formed in the first frame confronts the opening which is in the opened state for communication therewith, the developer passes through not only the opening but also the communication hole.

Here, when projected from the passage direction of developer at the opening in such a state that the opening is in the opened state, the seal member is exposed from the communication hole in such a manner as not to overlap the portion on the first frame which bounds the communication hole. Namely, since, in such a state that the opening is in the opened state, the seal member is exposed fully from the communication hole without contacting the portion on the first frame which bounds the communication hole, the deformation of the seal member can be prevented which would otherwise be caused through contact of the seal member with the first frame.

According to still another aspect of the invention, in the developer cartridge, wherein the first frame is provided outside of the second frame.

According to still another aspect of the invention, in the developer cartridge, wherein the first frame is provided outside of the second frame, and wherein the seal member projects further outwards than an external surface of the first frame when the opening is opened.

According thereto, since, in such a state that the first frame is provided on the outside of the second frame, the seal member projects further outwards than the external surface of the first frame in such a state that the opening is in the opened state, the seal member contacts closely an exterior member to which the developer is supplied from the developer cartridge, so as to prevent the leakage of the developer from a gap that would otherwise be generated between the exterior member and the opening.

According to still another aspect of the invention, in the developer cartridge, wherein the first frame comprises a first frame side confronting portion that confronts the seal member when the second frame moves relative to the first frame, and wherein the first frame side confronting portion comprises an inclined surface.

According thereto, the inclined surface is formed on the first frame side confronting portion on the first frame which confronts the seal member when the second frame moves relative to the first frame. Thus, when the second frame moves relative to the first frame, the seal member and the first frame can be made to contact each other moderately on the inclined surface of the first frame side confronting portion. Therefore, even though the seal member and the first frame contact each other, the seal member can be prevented from being damaged.

In addition, the seal member and the first frame are made to contact each other moderately on the inclined surface on the first frame side confronting portion. Thus, for example, in the event that the first frame is provided on the outside of the second frame, when the second frame moves relative to the first frame, the seal member can move into an inside of the first frame smoothly without being caught on the first frame side confronting portion.

According to still another aspect of the invention, in the developer cartridge, wherein the seal member comprises a seal member side confronting portion that confronts the first frame when the second frame moves relative to the first frame, and wherein the seal member side confronting portion comprises an inclined surface.

According thereto, the inclined surface is formed on the seal member side confronting portion on the seal member which confronts the first frame when the second frame moves relative to the first frame. Thus, when the second frame moves relative to the first frame, the seal member and the first frame can be made to contact each other moderately on the inclined surface of the seal member side confronting portion. Therefore, even though the seal member and the first frame contact each other, the seal member can be prevented from being damaged.

In addition, the seal member and the first frame are made to contact each other moderately on the inclined surface on the seal member side confronting portion. Thus, for example, in the event that the first frame is provided on the outside of the second frame, when the second frame moves relative to the first frame, the seal member can move into the inside of the first frame smoothly without being caught on the first frame side confronting portion at the seal member side confronting portion.

What is claimed is:

1. A developer cartridge comprising:
a first frame comprising a communication hole; and
a second frame, which confronts the first frame, and which comprises:
an opening, through which developer is passed, and which is openable and closable by the first frame in accordance with a relative movement between the second frame and the first frame; and
a seal member, which is provided around the opening, and which does not overlap the first frame as viewed from a direction in which the developer passes the opening when the opening is opened,
wherein the communication hole of the first frame communicates with the opening of the second frame when the opening is opened, and
wherein the seal member is exposed from the communication hole when the opening is opened.

2. The developer cartridge according to claim 1,
wherein the seal member does not overlap a portion of the first frame that bounds the communication hole so as to be exposed from the communication hole as viewed from the direction in which the developer passes the opening when the opening is opened.

3. The developer cartridge according to claim 1, wherein the first frame is provided outside of the second frame.

4. The developer cartridge according to claim 1,
wherein the first frame is provided outside of the second frame, and
wherein the seal member projects further outwards than an external surface of the first frame when the opening is opened.

5. The developer cartridge according to claim 1,
wherein the first frame comprises a first frame side confronting portion that confronts the seal member when the second frame moves relative to the first frame, and
wherein the first frame side confronting portion comprises an inclined surface.

6. The developer cartridge according to claim 1,
wherein the seal member comprises a seal member side confronting portion that confronts the first frame when the second frame moves relative to the first frame, and
wherein the seal member side confronting portion comprises an inclined surface.

7. The developer cartridge according to claim 1, wherein the seal member projects further outwards than an external surface of the first frame when the opening is opened.

8. A developing unit comprising:
a developer cartridge comprising:
a first frame comprising a communication hole; and
a second frame, which confronts the first frame, and which comprises:
an opening, through which developer is passed, and which is openable and closable by the first frame in accordance with a relative movement between the second frame and the first frame; and
a seal member, which is provided around the opening, and which does not overlap the first frame as viewed from a direction in which the developer passes the opening when the opening is opened,
wherein the communication hole of a first frame communicates with the opening of the second frame when the opening is opened,
wherein the seal member is exposed from the communication hole when the opening is opened, and
wherein the developing unit visualizes an electrostatic latent image with the developer in the developer cartridge.

9. The developing unit according to claim 8, wherein the seal member projects further outwards than an external surface of the first frame when the opening is opened.

10. An image forming apparatus comprising:
a developer cartridge comprising:
a first frame comprising a communication hole; and
a second frame, which confronts the first frame, and which comprises:
an opening, through which developer is passed, and which is openable and closable by the first frame in accordance with a relative movement between the second frame and the first frame; and
a seal member, which is provided around the opening, and which does not overlap the first frame as viewed from a direction in which the developer passes the opening when the opening is opened,
wherein the communication hole of the first frame communicates with the opening of the second frame when the opening is opened, and
wherein the seal member is exposed from the communication hole when the opening is opened; and
an image forming apparatus main body to which the developer cartridge is mounted.

11. The image forming apparatus according to claim 10, wherein the seal member projects further outwards than an external surface of the first frame when the opening is opened.

* * * * *